US005702311A

United States Patent [19]

Higuchi et al.

[11] Patent Number: 5,702,311

[45] Date of Patent: Dec. 30, 1997

[54] MULTI-PIECE SOLID GOLF BALL

[75] Inventors: Hiroshi Higuchi; Hisashi Yamagishi, both of Chichibu, Japan

[73] Assignee: Bridgestone Sports Co., Ltd., Tokyo, Japan

[21] Appl. No.: 637,602

[22] Filed: Apr. 25, 1996

[30] Foreign Application Priority Data

May 12, 1995 [JP] Japan ..... 7-138552

[51] Int. Cl.$^6$ ..... A63B 37/06; A63B 37/12

[52] U.S. Cl. ..... 473/373; 473/374; 473/376

[58] Field of Search ..... 473/352, 373, 473/374, 376

[56] References Cited

U.S. PATENT DOCUMENTS

| | | | |
|---|---|---|---|
| 4,085,937 | 4/1978 | Schenk | 473/352 |
| 4,863,167 | 9/1989 | Matsuki et al. | 473/373 |
| 5,002,281 | 3/1991 | Nakahara et al. | 473/373 |
| 5,072,944 | 12/1991 | Nakahara et al. | 473/373 |
| 5,490,674 | 2/1996 | Hamada et al. | 473/373 |
| 5,553,852 | 9/1996 | Higuchi et al. | 473/373 |
| 5,556,098 | 9/1996 | Higuchi et al. | 473/374 |

FOREIGN PATENT DOCUMENTS

| | | |
|---|---|---|
| 2276093 | 9/1994 | United Kingdom . |
| 2276628 | 10/1994 | United Kingdom . |

*Primary Examiner*—George J. Marlo

*Attorney, Agent, or Firm*—Sughrue, Mion, Zinn, Macpeak & Seas, PLLC

[57] ABSTRACT

In a multi-piece solid golf ball wherein a solid core of a multilayer structure including an innermost core and at least one intermediate layer enclosing the innermost core is surrounded by a cover, the golf ball has a specific gravity of 1.0–1.1 g/cm$^3$ and a distortion A of 2.5–4.0 mm under a load of 100 kg, the innermost core has a distortion B of 3.0–6.0 mm under a load of 100 kg, wherein $1.2 \leqq B/A \leqq 1.7$, and the cover has a greater hardness than the hardness of the innermost core. The ball will follow an appropriate high trajectory when hit by those golf players with a head speed of less than 40 m/sec. The ball is improved in flying performance, flying distance, feeling, impact, and durability.

14 Claims, 1 Drawing Sheet

MULTI-PIECE SOLID GOLF BALL

BACKGROUND OF THE INVENTION

1. Field of the Invention

This invention relates to a multi-piece solid golf ball suitable for those golf players who swing at a relatively low head speed.

2. Prior Art

For golf balls, various proposals have been made for improving their flying distance and hitting feel. This is also true for multi-piece solid golf balls.

Most of these advanced golf balls target those golf players who swing at a relatively high head speed, that is, experienced players. Then those golf players capable of high head speed swing can take advantage of the advanced balls, enjoying an increased flying distance and a pleasant feeling. However, those golf players who swing at a low speed and are slow in head speed, including a beginner, female and senior players cannot take full advantage of the advanced balls.

Usually, players with a slow head speed select softer ones of the advanced balls. Since the softer balls, however, are not originally designed optimum for slow-head-speed players, the balls not only follow a low trajectory rather than a high trajectory upon hitting, failing to extend a flying distance, but also offer a less pleasant feel upon hitting.

SUMMARY OF THE INVENTION

An object of the present invention is to provide a novel and improved multi-piece solid golf ball which is increased in flying distance and gives a pleasant feel when those golf players who are slow in head speed, including beginner, female and senior players use it.

The invention pertains to a multi-piece solid golf ball comprising a solid core of a multilayer structure including an innermost core and at least one intermediate layer enclosing the innermost core. The solid core is surrounded by a cover. We have found that the golf ball is improved when the ball has a specific gravity of 1.0 to 1.1 g/cm$^3$ and a distortion of A mm under a load of 100 kg, the innermost core has a distortion of B mm under a load of 100 kg, A and B are controlled such that $1.2 \leqq B/A \leqq 1.7$, preferably A ranges from 2.5 to 4.0 mm and B ranges from 3.0 to 6.0 mm, and the cover has a greater hardness than the hardness of the innermost core, preferably a Shore D hardness of at least 50 degrees. When hit by golfers who are slow in head speed, the golf ball will follow an adequate high trajectory, extend a flying distance, and offer a pleasant feel.

More particularly, ordinary golf balls are designed optimum for experienced and professional golfers capable of high head speed swing. When a player who swings at a slow head speed of less than 40 m/sec. hits such an ordinary golf ball with a driver, the ball will frequently follow a low trajectory, failing to fly a satisfactory distance. Since the ball of the invention is made lightweight to increase its lift by reducing its specific gravity in the range of 1.0 to 1.1 g/cm$^3$ below the specific gravity level of ordinary balls, the ball tends to fly high and gain a higher initial velocity even at a low head speed, covering a longer flying distance. By controlling the ratio of the distortion B (mm) of the innermost core to the distortion A (mm) of the ball to fall in the above-defined range, the ball is improved in feeling, that is, gives a pleasant feel, soft and light impact upon hitting, and when hit at a low head speed, yields a sufficient amount of deformation to improve its flying performance and travel an increased flying distance. By increasing the cover hardness within a permissible range, the ball becomes more durable.

DETAILED DESCRIPTION OF THE INVENTION

The multi-piece solid golf ball of the present invention is adjusted in ball specific gravity, ball hardness, innermost core hardness, and cover hardness so that the ball may offer an increased flying distance and a pleasant feel when hit by those players who swing at a relatively low head speed and be fully durable. Included in the multi-piece solid golf balls of the invention are three-piece solid golf balls having a solid core of the two-layer structure consisting of an innermost core and an intermediate layer and a cover and multi-piece solid golf balls having a solid core consisting of three, four or more layers.

The golf ball as a whole has a specific gravity of 1.0 to 1.1 g/cm$^3$, preferably 1.00 to 1.08 g/cm$^3$. A ball with a specific gravity of less than 1.0 is felt neither light nor soft, is likely to receive wind resistance in flight so that its trajectory may be deflected, and is too low in inertial force to travel a long flying distance. On the other hand, a ball having a specific gravity of more than 1.1 is not different from conventional golf balls or usual field-play golf balls, failing to attain the objects of the invention.

The ball should have a weight of not greater than 45.92 g as prescribed in the Rules of Golf. For the objects of the invention, the ball preferably has a weight of 40.8 g to 45.0 g, especially 41.1 to 44.9 g.

Figure 1A:
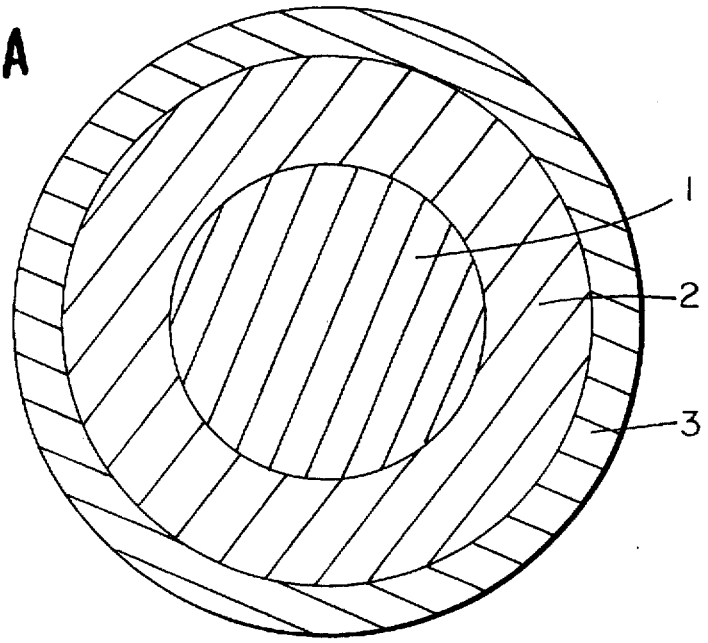
FIGS. 1A and 1B schematic cross sections of a solid golf ball according to the invention.

In the golf ball of the invention, as illustrated in FIG. 1A the solid core consisting of an innermost core 1 and at least one intermediate layer 2 is enclosed with a cover 3. According to the invention, provided that the golf ball is subject to a distortion of A mm under a load of 100 kg and the innermost core is subject to a distortion of B mm under a load of 100 kg, the ratio B/A ranges from 1.2 to 1.7, preferably from 1.2 to 1.6. Despite the light weight, the ratio B/A in this range prevents the ball from flying sharply upward, allows the ball to fly a longer distance, and ensures a pleasant feel. A ratio B/A of less than 1.2 leads to an unpleasant feel, sharply upward fly, and shorter flying distance whereas a ball with a ratio B/A of more than 1.7 would cover a shorter flying distance because of low restitution.

While the ratio B/A is in the above-defined range, the value of B, that is, the distortion of the innermost core is preferably 3.0 to 6.0 mm, especially 3.3 to 5.5 mm. Hitting feel would be poor with B<3.0 mm. A ball with B>6.0 mm would cover a shorter flying distance because of low restitution. In turn, the value of A, that is, the distortion of the golf ball is preferably 2.5 to 4.0 mm, especially 2.6 to 3.7 mm. A ball with A<2.5 mm would be poor in hitting feel, fly sharply upward, and travel a shorter distance. A ball with A>4.0 mm would cover a shorter flying distance because of low restitution.

Figure 1B:
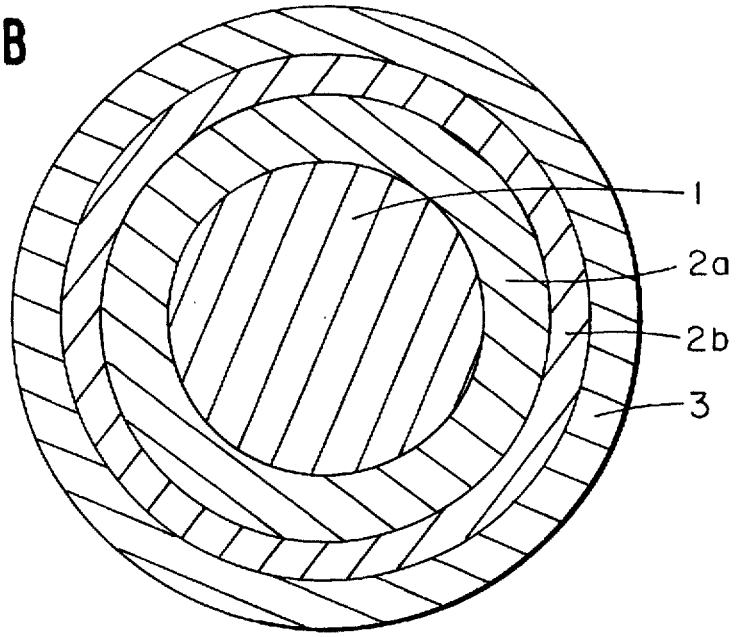

The diameter and weight of the innermost core 1 varies with the number of intermediate layers. The diameter is preferably 32 to 37 mm for a three-piece solid golf ball having a single intermediate layer (FIG. 1A) and 25 to 35 mm for a four-piece solid golf ball having two intermediate layers (FIG. 1B). Similarly, the weight of the innermost core is preferably 17.5 to 28.0 g for a three-piece solid golf ball and 8.3 to 23.5 g for a four-piece solid golf ball.

Also preferably the intermediate layer a surrounding the innermost core has a Shore D hardness of 30 to 55 degrees for a three-piece solid golf ball. In the case of a four-piece solid golf ball having two, inner and outer intermediate layers, the inner intermediate layer 2A, 2B preferably has a Shore D hardness of 55 to 75 degrees and the outer intermediate layer preferably has a Shore D hardness of 30 to 55 degrees. This construction is illustrated in FIG. 1B.

The cover surrounding the solid core is formed to a greater hardness than the hardness of the innermost core, preferably a Shore D hardness of at least 50 degrees, more preferably at least 60 degrees, most preferably 60 to 70 degrees. If the cover hardness is too low, the ball would become less repulsive and receive a greater spin and a larger launch angle upon hitting so that the ball may climb high and stall, failing to travel a long flying distance. Too increased cover hardness means that the cover is too hard so that the golf ball may be less durable.

Preferably the cover 3 is formed around the core 1 to a gauge (radial thickness) of 1.4 to 2.4 mm, especially 1.5 to 2.3 mm. A cover of less than 1.4 mm in gauge would be low in cut resistance so that the ball might be less durable. A cover of more than 2.4 mm in gauge would give a dull feel upon hitting and a ball with such a thick cover would become less repulsive.

The cover 3 may be formed of any of well-known materials. Cover materials based on ionomer resins, especially lithium Surlyn and Surlyn mixtures containing the same are preferred for achieving the objects of the invention.

The solid core 1 may be formed of any desired material by any desired method. Any of well-known materials may be used for the core insofar as a golf ball with desirable properties is obtained.

More particularly, the innermost core of the solid core of the solid golf ball according to the invention is formed by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 3 parts by weight, preferably about 0.8 to 1.5 parts by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 5 to 45 parts by weight, preferably about 10 to 40 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably 0 to about 40 parts by weight per 100 parts by weight of the base rubber although the amount largely varies with the specific gravity of the core and cover, the weight of the ball, and other factors. In the practice of the invention, the amount of the filler (typically zinc oxide and barium sulfate) is properly selected so as to provide the desired hardness to the innermost core.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining an innermost core.

Where the solid core consists of an innermost core and a single intermediate layer as in the three-piece golf ball, the intermediate layer may be formed of a composition similar to the composition used for the innermost core or another resin composition based on an ionomer resin or the like. The intermediate layer can be formed on the innermost core by compression molding or injection molding. Where more than one intermediate layer is included, they may be similarly formed.

The cover 3 is formed of a composition based on an ionomer resin satisfying the above-mentioned requirements. Such requirements are conveniently met by a mixture of two or more ionomer resins. If desired, well-known additives such as titanium white may be added to the ionomer resin(s). The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The geometrical arrangement of dimples may be octahedral, eicosahedral or the like while the dimple pattern may be selected from square, hexagon, pentagon, and triangle patterns.

The golf ball of the invention is prepared in accordance with the Rules of Golf, that is, to a diameter of at least 42.67 mm, preferably 42.67 mm to 44.20 mm and a weight of not greater than 45.92 g, preferably 40 g to 45 g.

EXAMPLE

Examples of the present invention are given below by way of illustration and not by way of limitation. All parts are by weight.

Examples 1–5 & Comparative Examples 1–2

An innermost core was prepared by milling an innermost core-forming rubber composition of the formulation shown in Table 1 in a Banbury mixer and compression molding it at 155° C. for 15 minutes. An intermediate layer-forming composition of the formulation shown in Table 2 was injection molded over the innermost core to form a two-piece solid core (Examples 1–4 & Comparative Example 2). In Example 5, another intermediate layer was formed over the two-piece solid core to form a three-piece solid core. Comparative Example 1 was a one-piece solid core consisting solely of the innermost core.

A cover-forming composition of the formulation shown in Table 1 was injection molded over the solid core, obtaining golf balls of Examples 1–5 and Comparative Examples 1–2.

TABLE 1

| | E1 | E2 | E3 | E4 | E5* | CE1 | CE2 |
|---|---|---|---|---|---|---|---|
| Solid core composition (pbw) | | | | | | | |
| Innermost core | | | | | | | |
| Cis-1,4-polybutadiene | 100 | 100 | 100 | 100 | 100 | 100 | 100 |
| Zinc acrylate | 20 | 15 | 23 | 20 | 15 | 25 | 29 |
| ZnO | 7 | 5 | 6 | 7 | 9 | 24 | 5 |
| Antioxidant | 0.2 | 0.2 | 0.2 | 0.2 | 0.2 | 0.2 | 0.2 |
| Dicumyl peroxide | 0.65 | 0.65 | 0.65 | 0.65 | 0.65 | 0.65 | 0.65 |
| Intermediate layer | | | | | | | |
| Hitrel 4047 | 100 | — | — | 100 | — | — | 100 |
| Hitrel 4057 | — | — | 100 | — | — | — | — |
| Hitrel 4767 | — | 100 | — | — | — | — | — |
| Himilan 1706 (inner) | — | — | — | — | 100 | — | — |
| Hitrel 4047 (outer) | — | — | — | — | 100 | — | — |
| Cover composition (pbw) | | | | | | | |
| Himilan 1605 | 50 | — | — | 50 | 50 | 50 | 50 |
| Himilan 1706 | 50 | — | — | 50 | 50 | 50 | 50 |
| Himilan 1650 | — | — | 100 | — | — | — | — |
| Himilan 1707 | — | 100 | — | — | — | — | — |

*In Example 5, the intermediate layer consisted of an inner intermediate layer of Himilan 1706 and an outer intermdiate layer of Hitrel 4047.

The parameters of the innermost core, intermediate layer, cover, and ball are shown in Table 2.

The golf balls were examined for flying performance, feeling and durability by the following tests.

Flying test

Using a swing robot, the ball was hit by a driver (#1 wood) at a head speed (HS) of 40 m/sec. and 35 m/sec. for determining spin, launch angle, carry, total, and in-flight angle. The driver had a loft angle of 11°.

Feeling test

Using a panel of twenty ordinary golfers who swung at a head speed of about 40 m/sec., the ball was evaluated for hitting feel. The rating was "0" when it was soft and light and "X" when it was hard.

Durability

Using a flywheel hitting machine M/C, the ball was repeatedly hit at a head speed of 38 m/sec. until the ball was broken. The number of hits was counted. The ball was rated "0" when it was fully durable and "X" when it was weak.

The results are shown in Table 2.

TABLE 2

| | E1 | E2 | E3 | E4 | E5 | CE1 | CE2 |
|---|---|---|---|---|---|---|---|
| Innermost core | | | | | | | |
| Diameter (mm) | 35.32 | 35.29 | 35.30 | 35.38 | 30.12 | 38.70 | 35.32 |
| Hardness B (mm) | 4.02 | 4.98 | 3.53 | 3.99 | 5.02 | 3.98 | 2.48 |
| Weight (g) | 23.99 | 23.47 | 23.95 | 24.12 | 14.88 | 35.08 | 23.99 |
| Intermediate layer | | | | | | | |
| Gage (mm) | 1.70 | 1.70 | 1.70 | 2.01 | 4.50 | — | 1.71 |
| Shore D | 40 | 45 | 40 | 40 | | — | 40 |
| Cover | | | | | | | |
| Gage (mm) | 2.00 | 2.01 | 1.99 | 2.29 | 1.79 | 2.00 | 2.00 |
| Shore D | 65 | 68 | 60 | 65 | 68 | 65 | 65 |
| Ball | | | | | | | |
| Diameter (mm) | 42.72 | 42.71 | 42.68 | 43.98 | 42.70 | 42.70 | 42.70 |
| Hardness A (mm) | 3.00 | 3.48 | 2.72 | 2.80 | 3.20 | 3.20 | 2.20 |
| Weight (g) | 41.95 | 41.46 | 41.84 | 44.82 | 42.22 | 45.50 | 42.04 |

TABLE 2-continued

| | E1 | E2 | E3 | E4 | E5 | CE1 | CE2 |
|---|---|---|---|---|---|---|---|
| Specific gravity | 1.03 | 1.02 | 1.03 | 1.01 | 1.04 | 1.12 | 1.03 |
| B/A | 1.34 | 1.43 | 1.30 | 1.43 | 1.57 | 1.24 | 1.13 |
| #W1/HS40 | | | | | | | |
| Spin (rpm) | 2690 | 2610 | 2760 | 2720 | 2620 | 2550 | 2850 |
| Launch angle (°) | 10.1 | 10.2 | 9.9 | 10.1 | 10.2 | 10.3 | 9.7 |
| Carry (m) | 181.7 | 181.4 | 182.1 | 181.6 | 181.3 | 178.3 | 179.8 |
| Total (m) | 193.2 | 192.7 | 193.4 | 193.0 | 192.5 | 190.9 | 190.8 |
| Flight angle (°) | 12.7 | 12.8 | 12.7 | 12.7 | 12.8 | 12.4 | 12.9 |
| Feel | ○ | ○ | ○ | ○ | ○ | ○ | X |
| #W1/HS35 | | | | | | | |
| Spin (rpm) | 3830 | 3750 | 3940 | 3870 | 3790 | 3660 | 4020 |
| Launch angle (°) | 10.5 | 10.6 | 10.4 | 10.5 | 10.6 | 10.8 | 10.2 |
| Carry (m) | 142.7 | 143.1 | 143.1 | 142.8 | 142.9 | 140.3 | 141.1 |
| Total (m) | 153.4 | 153.9 | 153.2 | 153.8 | 153.5 | 151.6 | 150.8 |
| Flight angle (°) | 13.1 | 13.0 | 13.2 | 12.9 | 12.9 | 12.3 | 13.5 |
| Feel | ○ | ○ | ○ | ○ | ○ | ○ | X |
| Durability | ○ | ○ | ○ | ○ | ○ | X | ○ |

Note: Hardness A or B is a distortion (mm) under a load of 100 kg, and B/A is a hardness ratio of innermost core to ball.

Note that in Example 5, the innermost core was surrounded by the intermediate layer consisting of two layers, an inner intermediate layer having a gauge of 2.5 mm and a Shore D hardness of 68° and an outer intermediate layer having a gauge of 2.0 mm and a Shore D hardness of 40°.

It is evident from Table 2 that the ball of Comparative Example 1 is less durable and the ball of Comparative Example 2 gives a hard impact and an unpleasant feeling, both traveling a somewhat shorter flying distance. The balls of Examples 1 to 5 are superior in flying distance, durability and hitting feel.

There has been described a multi-piece solid golf ball having specific parameters. The ball will follow an appropriate high trajectory rather than a low or sharply rising trajectory when hit by those golf players with a head speed of less than 40 m/sec. The ball is improved in flying performance and flying distance. The ball also has a pleasant feeling, a soft and light impact, and durability.

Although some preferred embodiments have been described, many modifications and variations may be made thereto in the light of the above teachings. It is therefore to be understood that within the scope of the appended claims, the invention may be practiced otherwise than as specifically described.

We claim:

1. A multi-piece solid golf ball comprising; a solid core of a multilayer structure including innermost core and at least one intermediate layer enclosing the innermost core, and a cover enclosing the solid core, said golf ball having a specific gravity of 1.0 to 1.1, a weight of 40.8 to 44.9 g and a distortion of A mm under a load of 100 kg, said innermost core having a distortion of B mm under a load of 100 kg, wherein B/A ranges from 1.2 to 1.7, and said cover having a shore D hardness of at least 50 and a greater hardness than the hardness of the innermost core.

2. The golf ball of claim 1 wherein said golf ball has a distortion A of 2.5 to 4.0 mm under a load of 100 kg and said innermost core has a distortion B of 3.0 to 6.0 mm under a load of 100 kg.

3. The golf ball of claim 1 wherein said innermost core is formed of a rubber composition comprising a base rubber containing 1,4-polybutadiene having at least 40% of cis-structure, a crosslinking agent in the form of an organic peroxide, a co-crosslinking agent in the form of a metal salt of acrylic acid or methacrylic acid and a filler, said intermediate layer is formed of a rubber composition or a resin composition, said rubber composition comprising a base rubber containing 1,4-polybutadiene having at least 40% of cis-structure, a crosslinking agent in the form of an organic peroxide, a co-crosslinking agent in the form of a metal salt of acrylic acid or methacrylic acid and a filler, and said resin composition being based on an ionomer resin, said cover composition is formed of a composition based on an ionomer resin.

4. The golf ball of claim 1 wherein said intermediate layer has a Shore D hardness in the range of 30 to 55.

5. The golf ball of claim 1 wherein said intermediate layer has a diameter in the range of 25 to 35 mm.

6. The golf ball of claim 1 wherein said innermost core has a weight in the range of 17.5 to 28.0 g.

7. The golf ball of claim 1 wherein said cover has a Shore D hardness in the range of 60–70.

8. The golf ball of claim 1 wherein said intermediate layer comprises inner and outer layers surrounding said innermost core.

9. The golf ball of claim 8 wherein said innermost core has a weight in the range of 8.3 to 23.5 g.

10. The golf ball of claim 8 wherein said inner layer has a Shore D hardness in the range of 55 to 75 and said outer intermediate layer has a Shore D hardness in the range of 30–55.

11. The golf ball of claim 8 wherein said innermost core has a diameter in the range of 25 to 35 mm.

12. The golf ball of claim 1 wherein said cover has a radial thickness in the range of 1.4 to 2.4 mm.

13. The golf ball of claim 1 wherein said golf ball has a diameter in the range of 42.67 to 44.20 mm.

14. The golf ball of claim 1 wherein said innermost core has a diameter in the range of 32 to 37 mm.

* * * * *